US005176748A

United States Patent [19]

Nikoloff et al.

[11] Patent Number: 5,176,748

[45] Date of Patent: Jan. 5, 1993

[54] ALKENYL SUCCINIC ANHYDRIDE EMULSION

[75] Inventors: Koyu Nikoloff, N. Kingston; Edward Takacs, Exeter, both of R.I.

[73] Assignee: Bercen, Inc., Cranston, R.I.

[21] Appl. No.: 704,900

[22] Filed: May 21, 1991

Related U.S. Application Data

[63] Continuation of Ser. No. 534,314, Jun. 5, 1990, abandoned, and a continuation of Ser. No. 214,777, Jul. 5, 1988, abandoned.

[51] Int. Cl.[5] ..... C08L 3/00; C09D 4/00; D21F 11/00; D21H 11/00

[52] U.S. Cl. ..... 106/211; 106/285; 162/158; 162/168.3; 162/173

[58] Field of Search ..... 162/168.3, 173, 158; 106/211, 285

[56] References Cited

U.S. PATENT DOCUMENTS

| | | | |
|---|---|---|---|
| Re. 28,474 | 7/1974 | Anderson et al. | 523/336 |
| Re. 28,576 | 10/1975 | Anderson et al. | 523/336 |
| Re. 29,960 | 4/1979 | Mazzarella et al. | 162/184 |
| 3,102,064 | 8/1963 | Wurzburg et al. | 162/158 |
| 3,821,069 | 6/1974 | Wurzburg | 162/158 |
| 3,968,005 | 7/1976 | Wurzburg | 162/168.4 |
| 4,017,440 | 4/1977 | Killam | 524/809 |
| 4,024,072 | 5/1977 | Shane et al. | 162/60 |
| 4,147,681 | 4/1979 | Lim et al. | 162/168.3 |
| 4,207,142 | 6/1980 | Shephard | 162/179 |
| 4,222,820 | 9/1980 | Hiskens et al. | 162/175 |
| 4,234,381 | 11/1980 | Killam | 162/158 |
| 4,330,450 | 5/1982 | Lipowski et al. | 162/168.3 |
| 4,529,447 | 7/1985 | Okada et al. | 106/287.24 |
| 4,606,773 | 8/1986 | Novak | 162/168.3 |
| 4,657,940 | 4/1987 | Konig | 521/164 |
| 4,657,946 | 4/1987 | Rende et al. | 523/402 |

FOREIGN PATENT DOCUMENTS

| | | |
|---|---|---|
| 0141641 | 5/1985 | European Pat. Off. . |
| 0200504 | 4/1986 | European Pat. Off. . |
| 2140049A | 3/1984 | United Kingdom . |

*Primary Examiner*—A. Lionel Clingman

[57] ABSTRACT

In sizing paper and paperboard with an aqueous ASA sizing system, a dispersal is formed comprising an ASA, a water-immiscible carrier, and a cationic water-soluble dispersing agent and when desired, a non-ionic surfactant. The dispersal can be shipped and stored for a prolonged time until use. The dispersal is added to water to form an oil-in-water sizing emulsion. This prepared emulsion is suitable for sizing paper and paperboard directly without the need for additional emulsifying agents or expensive equipment.

24 Claims, No Drawings

ALKENYL SUCCINIC ANHYDRIDE EMULSION

This is a continuation of co-pending application Ser. No. 07/534,314, now abandoned, filed on Jun. 5, 1990, and of U.S. Ser. No. 07/214,777, filed Jul. 5, 1988, now abandoned.

BACKGROUND OF THE INVENTION

This invention relates to sizing paper and paper products including paperboard.

For some time now alkenyl succinic anhydrides ("ASA's") have been used in sizing for paper products, to improve characteristics such as water and ink hold-out and chemical resistance. Wurzburg et al., U.S. Pat. No. 3,102,064, Wurzburg U.S. Pat. No. 3,821,069, and Wurzburg 3,968,005 disclose the use of various ASA's for this purpose.

ASA's tend to be hydrophobic, and they generally must be used in aqueous paper manufacturing systems. Considerable effort is required to achieve a uniform, stable ASA emulsion suitable for paper manufacture In particular, Warzburg '069 discloses the use of cationic agents (e g., various starch derivatives), together with other emulsifiers. Specifically, at 6:34–49, a corn starch ether dispersion is prepared in boiling water, and then ASA is slowly added with high-speed dispersion. The resulting stock emulsion is diluted and added to aqueous pulp slurries.

Mazzarella Re 29,960 (U.S. Pat. No. 4,040,900) discloses adding a liquid ASA sizing mixture directly to an aqueous paper stock system with low shear forces, using certain polyoxyalkylene aryl or polyoxyakylene alkyl-aryl ethers as emulsifiers Rende U.S. Pat. No 4,657,946 discloses the use of cationic water-soluble vinyl addition polymers and condensation polymers to emulsify ASA's. This procedure includes dispersing ASA in aqueous solutions of the vinyl additives polymers using a high speed or high-shear disperser and then diluting the resulting emulsion (8:23–28).

Shepard U.S. Pat. No. 4,207,142 and Hiskens et al. 4,222,820 disclose specific classes of ASA sizing agents which are emulsified to form sizing compositions.

Novak U.S. Pat. No. 4,606,773 discloses emulsifying ASA paper sizing agents using a cationically modified water-soluble polymer in conjunction with water-soluble cationic starch.

SUMMARY OF THE INVENTION

One aspect of the invention features novel methods for preparing ASA sizing mixtures. Specifically, a dispersal is formed comprising ASA and a cationic, water-soluble dispersing agent with a water immiscible carrier A non-ionic surfactant may also be included to improve the emulsion stability. Preferably, the dispersal contains less than 3% water by weight, and most preferably only traces of water or no water at all. In this way, a stable ASA dispersal is formed that is mixed with water at a later stage. The resulting dispersion is readily formed, without undesirable shear or heat. By avoiding water, ASA hydrolysis and degradation of the dispersing agent are avoided, thus increasing shelf life.

In preparation for sizing paper products, the ASA dispersal mixture described above is added to an aqueous medium to form the cationic oil-in-water emulsion. This prepared emulsion is easily formed and is suitable for sizing paper and paperboard directly without the need for additional emulsifying agents or expensive equipment.

The preferred cationic water-soluble dispersing agent is a cationic acrylamide polymer, such as diallyl dimethyl ammonium chloride (DADMAC)/acrylamide, preferably of molecular weight at least $5\times10^4$ daltons. Other agents are suitable including dimethylaminoethyl methacrylate (DMAEMA)/acrylamide copolymer and Manniched acrylamide homopolymer, a reaction product of polyacrylamide, dimethylamine and formaldehyde. The preferred water-immiscible carrier is mineral oil, but numerous other carriers are suitable, particularly hydrocarbons and mixtures thereof (aliphatic hydrocarbons being most preferred) having a molecular weight of 250 to 750 daltons or a viscosity of 50 to 700 SUS at 100° F. The preferred non-ionic surfactant is a block copolymer of ethylene oxide and propylene oxide.

The preferred dispersal has the following composition:

| | |
|---|---|
| ASA: | 45–96% |
| carrier: | 3–30% |
| disperser: | 3–30% |
| water: | 0–3% |
| non-ionic surfactant | 0–7% |

The most preferred composition of the dispersal is:

| | |
|---|---|
| ASA: | 90–92% |
| carrier: | 2.5–4% |
| disperser: | 2.5–4% |
| water: | 0 |
| non-ionic surfactant | 2–3% |

The ASA used in the invention can be any ASA suitable for sizing paper and paper products including paperboard, as described in the above-referenced patents which are hereby incorporated by reference. Preferred ASA's include: hexadecenyl and octadecenyl succinic anhydrides or mixtures thereof.

A second aspect of the invention specifically features the ASA/cationic water-soluble dispersing agent mixture in a water-immiscible carrier.

A third aspect of the invention features a method of forming the ASA dispersal of the second aspect of the invention, by providing a cationic emulsifier in a mixture of water and a water-immiscible carrier, and then removing water, e.g. by distillation; finally, ASA is added. This dispersal has a good shelf life and can be stored for ready and immediate use in paper product manufacturing processes.

This invention provides aqueous cationic ASA emulsions suitable for paper sizing, with relatively simple procedures (stirring as opposed to high-speed or high-shear dispersal) that reduce damage to the ASA because heating and high-speed shearing, which result in hydrolysis, are avoided. Hydrolysis is undesirable because it reduces the effectiveness of the sizing and creates dicarboxylic acid species that form undesirable insoluble complexes with ionic species in the water such as $Ca^{++}$ and $Mg^{++}$.

Other features and advantages of the invention will be apparent from the following description of a preferred embodiment thereof.

DESCRIPTION OF THE PREFERRED EMBODIMENT

The following specific example is offered to illustrate the invention, not as a limitation on its scope.

The preferred carrier and dispersant provided in the embodiment of this invention is prepared by copolymerizing the cationic and acrylamide monomers in a mineral oil and water mixture. Water is removed under reduced pressure when reaction is completed to leave a mixture comprising an approximate 1 to 1 mixture of cationic polyacrylamide and mineral oil and a trace of residual water. The carrier/dispersant is then mixed with the ASA (alkenyl succinic anhydride as described in previous patents). When utilized, the non-ionic surfactant may be added to the dispersal at this point. The dispersal is activated by adding it to the vortex of rapidly stirring water at a concentration of 1 to 5%.

In one specific example a cationic polyacrylamide, having a molecular weight of from 1 to 5 million, is prepared in emulsified form, by copolymerizing acrylamide with from 3 to 10 mol % of a cationic monomer selected from a list which includes diallyldimethyl ammonium chloride, dimethylaminoethyl methacrylate, B-methacrylyloxyethyl trimethylammonium methyl sulfate, diallyldiethyl ammonium chloride, diethyl (2-hydroxyethyl) methylammonium methyl sulfate and N-(Dimethylamino)methyl)-acrylamide.

The cationic emulsion, which normally contains equal parts of polymer, mineral oil and water, is prepared by conventional emulsion polymerization techniques known to those skilled in the art. Water is then removed from the emulsion by azeotropic distillation with toluene, over a temperature range of 80°-110° C. The dispersion of cationic polymer in the remaining mineral oil generally has a water content of from 0 to 1% and typically contains from 0.1 to 0.3% water.

This substantially dried (i.e. water-free) dispersion is then blended with: (1) an alkenyl succinic anhydride (e.g. a mixture of hexadecenyl and octadecenyl succinic anhydrides) having a carbon chain length of from 15 to 20 carbon atoms, available from Bercen, Inc., Cranston, R.I. and others; and (2) a non-ionic surfactant, preferably a block copolymer of ethylene oxide and propylene oxide such as the Pluronics TM made by B.A.S.F. Blending is done in a conventional manner by admixing the components at ambient temperature.

The resulting dispersal is easily formed and relatively stable, so as to be suitable for shipping to and storage at paper manufacturing facilities. At the time of sizing, the dispersal is activated by adding it to the vortex of rapidly stirring water (so as to prepare an emulsion from 1-5% concentration).

Other embodiments are within the following claims.

We claim:

1. A method for forming a dispersal product comprising alkenyl succinic anhydride and a cationic water-soluble polyacrylamide dispersing agent in a water-immiscible hydrocarbon carrier, said dispersal product being suitable for addition to water to yield an oil-in-water sizing emulsion, said method comprising:

first providing said cationic water-soluble polyacrylamide dispersing agent in a mixture of water and said water-immiscible hydrocarbon carrier;

then removing the water until said mixture contains less than 0.3% water, by weight, and finally adding sufficient alkenyl succinic anhydride to form said dispersal product, so that said dispersal product has no more than a trace of water.

2. The method of claim 1 in which a nonionic surfactant is added to form said dispersal product.

3. The method of claim 1 or claim 2 in which said alkenyl succinic anhydride is added in an amount so that said dispersal product is at least 90% by weight alkenyl succinic anhydride and less than 0.03% water by weight.

4. A method of preparing a mixture for sizing paper or paper products with alkenyl succinic anhydride comprising:

first forming a dispersal product comprising alkenyl succinic anhydride, a water-immiscible hydrocarbon carrier, and cationic water-soluble polyacrylamide dispersing agent, the dispersal product comprising no more than a trace of water; and then adding said dispersal product to water to form an oil-in-water ASA sizing emulsion.

5. The method of claim 1 or 4 in which the water-immiscible hydrocarbon carrier has a molecular weight between 250 and 750 daltons.

6. The method of claim 1 or 4 in which the water-immiscible hydrocarbon carrier has a viscosity between 50 and 700 SUS at 100° F.

7. The method of claim 1 or 4 in which the water immiscible hydrocarbon carrier is an aliphatic hydrocarbon.

8. The method of claim 4 in which said dispersal product comprises no more than 0.03% water by weight.

9. The method of claim 4 or claim 8 in which said dispersal product comprises at least 90% alkenyl succinic anhydride by weight.

10. The method of claim 1 or 4 in which said dispersal product comprises (by weight):

a polyacrylamide dispersing agent at 3-30%;

a hydrocarbon carrier at 3-30%; and a non-ionic surfactant at 0-7%.

11. The method of claim 1 or 4 in which said dispersal product comprises less than 7% of a non-ionic surfactant.

12. The method of claim 11 in which the non-ionic surfactant is a block copolymer of ethylene oxide and propylene oxide.

13. The method of claim 4 in which the dispersal product of alkenyl succinic anhydride is sprayed under pressure into an aqueous mixture to form an oil-in-water emulsion.

14. An alkenyl succinic anhydride dispersal product comprising an ASA, a water-immiscible hydrocarbon carrier, a cationic polyacrylamide water-soluble dispersing agent, and no more than a trace of water.

15. The dispersal product of claim 14 in which the water-immiscible hydrocarbon has a molecular weight between 250 and 750 daltons.

16. The dispersal product of claim 14 in which the water-immiscible hydrocarbon carrier has a viscosity between 50 and 700 SUS at 100° F.

17. The dispersal product of claim 14 in which the hydrocarbon is an aliphatic hydrocarbon.

18. The dispersal product of claim 14 further characterized in that said dispersal comprises no more than 0.03% water by weight.

19. The dispersal product of claim 14 or claim 18 in which said dispersal comprises at least 90% alkenyl succinic anhydride by weight.

20. The dispersal product of claim 14 in which said dispersal comprises (by weight):

a polyacrylamide dispersing agent at 3–30%:

a hydrocarbon carrier at 3–30%; and a non-ionic surfactant at 0–7%.

21. The dispersal product of claim 14 further comprising less than 7% (by weight) of a non-ionic surfactant.

22. The dispersal product of claim 21 in which said non-ionic surfactant is a block co-polymer of ethylene oxide and propylene oxide.

23. The method of claim 1 or 4 in which said dispersal product comprises 45–96% alkenyl succinic anhydride by weight.

24. The dispersal product of claim 14 in which said dispersal product comprises 45–96% alkenyl succinic anhydride by weight.

* * * * *